US009117455B2

(12) United States Patent
Tracey et al.

(10) Patent No.: US 9,117,455 B2
(45) Date of Patent: Aug. 25, 2015

(54) ADAPTIVE VOICE INTELLIGIBILITY PROCESSOR

(75) Inventors: James Tracey, Laguna Niguel, CA (US); Daekyong Noh, Newport Beach, CA (US); Xing He, Tustin, CA (US)

(73) Assignee: DTS LLC, Calabasas, CA (US)

( * ) Notice: Subject to any disclaimer, the term of this patent is extended or adjusted under 35 U.S.C. 154(b) by 88 days.

(21) Appl. No.: 13/559,450

(22) Filed: Jul. 26, 2012

(65) Prior Publication Data

US 2013/0030800 A1 Jan. 31, 2013

Related U.S. Application Data

(60) Provisional application No. 61/513,298, filed on Jul. 29, 2011.

(51) Int. Cl.

| | |
|---|---|
| ***G10L 25/90*** | (2013.01) |
| ***G10L 25/93*** | (2013.01) |
| ***G10L 25/00*** | (2013.01) |
| ***G10L 21/00*** | (2013.01) |

(Continued)

(52) U.S. Cl.

CPC ..... *G10L 21/003* (2013.01); *G10L 19/07* (2013.01); *G10L 21/0316* (2013.01); *G10L 21/0364* (2013.01); *G10L 25/15* (2013.01)

(58) Field of Classification Search

CPC ..... G10L 25/93; G10L 25/90; G10L 19/12; G10L 21/0208; G10L 15/20; G11C 2207/16; H05K 999/99; H03G 3/32; H04R 25/502

USPC ..... 704/219, 207, 223, 201, 200, 226, 206, 704/225, 214, 233; 381/57, 320, 94.3

See application file for complete search history.

(56) References Cited

U.S. PATENT DOCUMENTS

| | | | |
|---|---|---|---|
| 3,101,446 | A | 8/1963 | Glomb et al. |
| 3,127,477 | A | 3/1964 | David, Jr. et al. |

(Continued)

FOREIGN PATENT DOCUMENTS

| | | |
|---|---|---|
| DE | 10323126 | 8/2003 |
| GB | 2327835 | 2/1999 |
| WO | WO 01/31632 | 5/2001 |

OTHER PUBLICATIONS

International Search Report and Written Opinion issued in Application No. PCT/US2012/048378 on Jan. 24, 2014.

(Continued)

*Primary Examiner* — Pierre-Louis Desir
*Assistant Examiner* — Anne Thomas-Homescu
(74) *Attorney, Agent, or Firm* — Knobbe, Martens, Olson & Bear, LLP

(57) ABSTRACT

Systems and methods for adaptively processing speech to improve voice intelligibility are described. These systems and methods can adaptively identify and track formant locations, thereby enabling formants to be emphasized as they change. As a result, these systems and methods can improve near-end intelligibility, even in noisy environments. The systems and methods can be implemented in Voice-over IP (VoIP) applications, telephone and/or video conference applications (including on cellular phones, smart phones, and the like), laptop and tablet communications, and the like. The systems and methods can also enhance non-voiced speech, which can include speech generated without the vocal track, such as transient speech.

21 Claims, 10 Drawing Sheets

(51) Int. Cl.

| | |
|---|---|
| ***G10L 19/12*** | (2013.01) |
| ***G10L 19/02*** | (2013.01) |
| ***G10L 21/02*** | (2013.01) |
| ***G10L 15/00*** | (2013.01) |
| ***G10L 15/20*** | (2006.01) |
| ***H03G 3/20*** | (2006.01) |
| ***H04R 25/00*** | (2006.01) |
| ***H04B 15/00*** | (2006.01) |
| ***G10L 21/003*** | (2013.01) |
| *G10L 21/0316* | (2013.01) |
| *G10L 21/0364* | (2013.01) |
| *G10L 19/07* | (2013.01) |
| *G10L 25/15* | (2013.01) |

(56) References Cited

U.S. PATENT DOCUMENTS

| | | | | |
|---|---|---|---|---|
| 3,327,057 | A * | 6/1967 | Coker | 704/209 |
| 4,454,609 | A * | 6/1984 | Kates | 381/320 |
| 4,586,193 | A * | 4/1986 | Seiler et al. | 704/261 |
| 4,630,304 | A * | 12/1986 | Borth et al. | 381/94.3 |
| 4,736,429 | A * | 4/1988 | Niyada et al. | 704/254 |
| 4,882,758 | A | 11/1989 | Uekawa et al. | |
| 4,969,192 | A * | 11/1990 | Chen et al. | 704/222 |
| 5,140,638 | A * | 8/1992 | Moulsley et al. | 704/219 |
| 5,175,769 | A | 12/1992 | Hejna, Jr. et al. | |
| 5,471,527 | A | 11/1995 | Ho et al. | |
| 5,537,479 | A | 7/1996 | Kreisel et al. | |
| 5,590,241 | A * | 12/1996 | Park et al. | 704/227 |
| 5,617,507 | A * | 4/1997 | Lee et al. | 704/200 |
| 5,677,987 | A | 10/1997 | Seki et al. | |
| 5,701,390 | A * | 12/1997 | Griffin et al. | 704/206 |
| 5,737,719 | A * | 4/1998 | Terry | 704/224 |
| 5,742,689 | A | 4/1998 | Tucker et al. | |
| 5,752,222 | A * | 5/1998 | Nishiguchi et al. | 704/201 |
| 5,864,798 | A * | 1/1999 | Miseki et al. | 704/225 |
| 5,890,108 | A * | 3/1999 | Yeldener | 704/208 |
| 5,930,373 | A * | 7/1999 | Shashoua et al. | 381/98 |
| 5,946,651 | A * | 8/1999 | Jarvinen et al. | 704/223 |
| 5,966,689 | A | 10/1999 | McCree | |
| 6,006,185 | A * | 12/1999 | Immarco | 704/251 |
| 6,047,253 | A * | 4/2000 | Nishiguchi et al. | 704/207 |
| 6,064,962 | A * | 5/2000 | Oshikiri et al. | 704/262 |
| 6,073,092 | A * | 6/2000 | Kwon | 704/219 |
| 6,073,093 | A * | 6/2000 | Zinser, Jr. | 704/220 |
| 6,122,607 | A * | 9/2000 | Ekudden et al. | 704/212 |
| 6,169,971 | B1 * | 1/2001 | Bhattacharya | 704/225 |
| 6,182,033 | B1 * | 1/2001 | Accardi et al. | 704/223 |
| 6,233,552 | B1 * | 5/2001 | Mustapha et al. | 704/209 |
| 6,240,384 | B1 * | 5/2001 | Kagoshima et al. | 704/220 |
| 6,292,775 | B1 * | 9/2001 | Holmes | 704/209 |
| 6,453,287 | B1 * | 9/2002 | Unno et al. | 704/219 |
| 6,523,003 | B1 * | 2/2003 | Chandran et al. | 704/225 |
| 6,606,388 | B1 * | 8/2003 | Townsend et al. | 381/17 |
| 6,704,711 | B2 | 3/2004 | Gustafsson et al. | |
| 6,732,073 | B1 * | 5/2004 | Kluender et al. | 704/233 |
| 6,766,176 | B1 | 7/2004 | Gupta et al. | |
| 6,768,801 | B1 | 7/2004 | Wagner et al. | |
| 6,993,480 | B1 * | 1/2006 | Klayman | 704/226 |
| 7,065,485 | B1 * | 6/2006 | Chong-White et al. | 704/208 |
| 7,152,032 | B2 | 12/2006 | Suzuki et al. | |
| 7,233,896 | B2 * | 6/2007 | Adut | 704/223 |
| 7,349,841 | B2 | 3/2008 | Furuta et al. | |
| 7,392,180 | B1 * | 6/2008 | Accardi et al. | 704/223 |
| 7,424,423 | B2 | 9/2008 | Bazzi et al. | |
| 8,170,879 | B2 * | 5/2012 | Nongpiur et al. | 704/268 |
| 8,280,730 | B2 * | 10/2012 | Song et al. | 704/225 |
| 8,321,208 | B2 * | 11/2012 | Tamura et al. | 704/205 |
| 8,620,647 | B2 * | 12/2013 | Gao et al. | 704/214 |
| 2001/0005822 | A1 * | 6/2001 | Fujii et al. | 704/200 |
| 2001/0044722 | A1 * | 11/2001 | Gustafsson et al. | 704/258 |
| 2002/0143527 | A1 * | 10/2002 | Gao et al. | 704/223 |
| 2003/0055636 | A1 * | 3/2003 | Katuo et al. | 704/225 |
| 2003/0065506 | A1 * | 4/2003 | Adut | 704/207 |
| 2003/0135374 | A1 * | 7/2003 | Hardwick | 704/264 |
| 2003/0158728 | A1 * | 8/2003 | Bi et al. | 704/207 |
| 2004/0042622 | A1 * | 3/2004 | Saito | 381/74 |
| 2004/0057586 | A1 | 3/2004 | Licht | |
| 2004/0071284 | A1 | 4/2004 | Abutalebi et al. | |
| 2004/0078200 | A1 | 4/2004 | Alves | |
| 2004/0260545 | A1 * | 12/2004 | Gao et al. | 704/222 |
| 2005/0065781 | A1 | 3/2005 | Tell et al. | |
| 2005/0075864 | A1 | 4/2005 | Kim | |
| 2005/0114119 | A1 * | 5/2005 | Oh et al. | 704/219 |
| 2005/0165608 | A1 * | 7/2005 | Suzuki et al. | 704/261 |
| 2005/0246170 | A1 | 11/2005 | Vignoli et al. | |
| 2006/0130637 | A1 | 6/2006 | Crewbouw | |
| 2006/0217976 | A1 * | 9/2006 | Gao et al. | 704/233 |
| 2007/0005351 | A1 * | 1/2007 | Sathyendra et al. | 704/223 |
| 2007/0025480 | A1 | 2/2007 | Tackin et al. | |
| 2007/0092089 | A1 | 4/2007 | Seefeldt et al. | |
| 2007/0118363 | A1 | 5/2007 | Sasaki et al. | |
| 2007/0134635 | A1 | 6/2007 | Hardy et al. | |
| 2007/0150269 | A1 * | 6/2007 | Nongpiur et al. | 704/226 |
| 2007/0156402 | A1 * | 7/2007 | Heiman | 704/242 |
| 2007/0174050 | A1 * | 7/2007 | Li et al. | 704/208 |
| 2007/0223577 | A1 * | 9/2007 | Ehara et al. | 375/240.03 |
| 2007/0233472 | A1 * | 10/2007 | Sinder et al. | 704/219 |
| 2007/0299659 | A1 * | 12/2007 | Chamberlain | 704/219 |
| 2008/0022009 | A1 | 1/2008 | Yuen et al. | |
| 2008/0027711 | A1 * | 1/2008 | Rajendran et al. | 704/201 |
| 2008/0126081 | A1 * | 5/2008 | Geiser et al. | 704/201 |
| 2008/0140395 | A1 * | 6/2008 | Yeldener | 704/226 |
| 2008/0140396 | A1 * | 6/2008 | Grosse-Schulte et al. | 704/227 |
| 2008/0170721 | A1 * | 7/2008 | Sun et al. | 381/98 |
| 2008/0228473 | A1 | 9/2008 | Kinoshita | |
| 2008/0232612 | A1 | 9/2008 | Tourwe | |
| 2008/0249772 | A1 | 10/2008 | Martynovich et al. | |
| 2008/0249784 | A1 * | 10/2008 | Stachurski | 704/500 |
| 2008/0281587 | A1 * | 11/2008 | Yoshida | 704/223 |
| 2008/0312916 | A1 * | 12/2008 | Konchitsky et al. | 704/226 |
| 2009/0112579 | A1 | 4/2009 | Li et al. | |
| 2009/0161883 | A1 | 6/2009 | Katsianos | |
| 2009/0175459 | A1 * | 7/2009 | Marumoto et al. | 381/57 |
| 2010/0036659 | A1 * | 2/2010 | Haulick et al. | 704/226 |
| 2010/0076755 | A1 * | 3/2010 | Morii | 704/220 |
| 2010/0100373 | A1 * | 4/2010 | Ehara | 704/219 |
| 2010/0114570 | A1 * | 5/2010 | Jeong et al. | 704/233 |
| 2010/0145685 | A1 * | 6/2010 | Nilsson et al. | 704/205 |
| 2010/0198588 | A1 * | 8/2010 | Sudo et al. | 704/205 |
| 2010/0204996 | A1 * | 8/2010 | Zeng et al. | 704/500 |
| 2011/0288858 | A1 * | 11/2011 | Gay et al. | 704/226 |
| 2012/0084084 | A1 * | 4/2012 | Zhu et al. | 704/233 |
| 2012/0089396 | A1 * | 4/2012 | Patel et al. | 704/249 |
| 2012/0130713 | A1 * | 5/2012 | Shin et al. | 704/233 |
| 2012/0209611 | A1 * | 8/2012 | Furuta et al. | 704/268 |
| 2012/0323571 | A1 * | 12/2012 | Song et al. | 704/225 |

OTHER PUBLICATIONS

Extended European Search Report issued in Application No. 09848326.6 on Jan. 8, 2014.

Roger Derry, PC Audio Editing with Adobe Audition 2.0 Broadcast, desktop and CD audio production, First edition 2006, Eisever Ltd.

P1 Audio Processor, White Paper, May 2003, Safe Sound Audio 2003.

Khalil C. Haddad, et al., Design of Digital Linear-Phase FIR Crossover Systems for Loudspeakers by the Method of Vector Space Projections, Nov. 1999, vol. 47, No. 11, pp. 3058-3066.

Schottstaedt, SCM Repositories—SND Revision 1.2, Jul. 21, 2007, SourceForge, Inc.

International Preliminary Report on Patentability issued in application No. PCT/US2009/053437 on Feb. 14, 2012.

Hu et al. "A Perceptually Motivated Approach for Speech Enhancement", IEEE Transactions on Speech and Audio Processing, Vol. 11, No. 5, Sep. 2003.

International Search Report and Written Opinion in PCT/US2009/056850, Nov. 2, 2009.

International Search Report and Written Opinion in PCT/US2009/053437, Oct. 2, 2009.

(56) References Cited

OTHER PUBLICATIONS

Anderton, Craig, "DC Offset: The Case of the Missing Headroom" Harmony Central. http://www.harmonycentral.com/docs/DOC-1082, Apr. 19, 2010.
Linear Predictive Coding (LPC), http://www.otolith.com/otolith/olt/lpc.html, (accessed Jul. 10, 2012), 4 pages, last updated Oct. 17, 1995.
Line Spectral Pairs, From Wikipdia, http://en.wikipedia.org/wiki/Line_spectral_pairs, (accessed Jul. 10, 2012), 2 pages, last modified Jun. 1, 2010.
Kabal et al., The Computation of Line Spectral Frequencies Using Chebyshev Polynomials, IEEE Transactions on Acoustics, Speech, and signal processing, ASSP-34(6):1419-1426, Dec. 1986.
English translation of Office Action in Chinese Application No. 201280047329.2 dated Apr. 3, 2015 in 10 pages.

* cited by examiner

ADAPTIVE VOICE INTELLIGIBILITY PROCESSOR

RELATED APPLICATION

This application claims priority under 35 U.S.C. §119(e) to U.S. Provisional Application No. 61/513,298 filed Jul. 29, 2011, entitled "Adaptive Voice Intelligibility Processor," the disclosure of which is hereby incorporated by reference in its entirety.

BACKGROUND

Mobile phones are often used in areas that include high background noise. This noise is often of such a level that intelligibility of the spoken communication from the mobile phone speaker is greatly degraded. In many cases, some communication is lost or at least partly lost because a high ambient noise level masks or distorts a caller's voice, as it is heard by the listener.

Attempts to minimize loss of intelligibility in the presence of high background noise have involved use of equalizers, clipping circuits, or simply increasing the volume of the mobile phone. Equalizers and clipping circuits can themselves increase background noise, and thus fail to solve the problem. Increasing the overall level of sound or speaker volume of the mobile phone often does not significantly improve intelligibility and can cause other problems such as feedback and listener discomfort.

SUMMARY

For purposes of summarizing the disclosure, certain aspects, advantages and novel features of the inventions have been described herein. It is to be understood that not necessarily all such advantages may be achieved in accordance with any particular embodiment of the inventions disclosed herein. Thus, the inventions disclosed herein may be embodied or carried out in a manner that achieves or optimizes one advantage or group of advantages as taught herein without necessarily achieving other advantages as may be taught or suggested herein.

In certain embodiments, a method of adjusting a voice intelligibility enhancement includes receiving an input voice signal and obtaining a spectral representation of the input voice signal with a linear predictive coding (LPC) process. The spectral representation can include one or more formant frequencies. The method can further include adjusting the spectral representation of the input voice signal with one or more processors to produce an enhancement filter configured to emphasize the one or more formant frequencies. In addition, the method can include applying the enhancement filter to a representation of the input voice signal to produce a modified voice signal with enhanced formant frequencies, detecting an envelope based on the input voice signal, and analyzing the envelope of the modified voice signal to determine one or more temporal enhancement parameters. Moreover, the method can include applying the one or more temporal enhancement parameters to the modified voice signal to produce an output voice signal. At least applying the one or more temporal enhancement parameters can be performed by one or more processors.

In certain embodiments, the method of the preceding paragraph can include any combination of the following features: where applying the one or more temporal enhancement parameters to the modified voice signal includes sharpening peaks in the one or more envelopes of the modified voice signal to emphasize selected consonants in the modified voice signal; where detecting the envelope includes detecting an envelope of one or more of the following: the input voice signal and the modified voice signal; and further including applying an inverse filter to the input voice signal to produce an excitation signal, such that said applying the enhancement filter to the representation of the input voice signal comprises applying the enhancement filter to the excitation signal.

In some embodiments, a system for adjusting a voice intelligibility enhancement includes an analysis module that can obtain a spectral representation of at least a portion of an input audio signal. The spectral representation can include one or more formant frequencies. The system can also include a formant enhancement module that can generate an enhancement filter that can emphasize the one or more formant frequencies. The enhancement filter can be applied to a representation of the input audio signal with one or more processors to produce a modified voice signal. Further, the system can also include a temporal enveloper shaper configured to apply a temporal enhancement to the modified voice signal based at least in part on one or more envelopes of the modified voice signal.

In certain embodiments, the system of the previous paragraph can include any combination of the following features: where the analysis module is further configured to obtain the spectral representation of the input audio signal using a linear predictive coding technique configured to generate coefficients that correspond to the spectral representation; further including a mapping module configured to map the coefficients to line spectral pairs; further including modifying the line spectral pairs to increase gain in the spectral representation corresponding to the formant frequencies; where the enhancement filter is further configured to be applied to one or more of the following: the input audio signal and an excitation signal derived from the input audio signal; where the temporal envelope shaper is further configured to subdivide the modified voice signal into a plurality of bands, and wherein the one or more envelopes correspond to an envelope for at least some of the plurality of bands; further including a voice enhancement controller that can configured to adjust a gain of the enhancement filter based at least partly on an amount of detected environmental noise in an input microphone signal; further including a voice activity detector configured to detect voice in the input microphone signal and to control the voice enhancement controller responsive to the detected voice; where the voice activity detector is further configured to cause the voice enhancement controller to adjust the gain of the enhancement filter based on a previous noise input responsive to detecting voice in the input microphone signal; and further including a microphone calibration module configured to set a gain of a microphone configured to receive the input microphone signal, wherein the microphone calibration module is further configured to set the gain based at least in part on a reference signal and a recorded noise signal.

In some embodiments, a system for adjusting a voice intelligibility enhancement includes a linear predictive coding analysis module that can apply a linear predictive coding (LPC) technique to obtain LPC coefficients that correspond to a spectrum of an input voice signal, where the spectrum includes one or more formant frequencies. The system may also include a mapping module that can map the LPC coefficients to line spectral pairs. The system can also include a formant enhancement module that includes one or more processors, where the formant enhancement module can modify the line spectral pairs to thereby adjust the spectrum of the input voice signal and produce an enhancement filter that can emphasize the one or more formant frequencies. The enhancement filter can be applied to a representation of the input voice signal to produce a modified voice signal.

In various embodiments, the system of the previous paragraph can include any combination of the following features: further including a voice activity detector that can detect voice in an input microphone signal and to cause a gain of the enhancement filter to be adjusted responsive to detecting voice in the input microphone signal; further including a microphone calibration module that can set a gain of a microphone that can receive the input microphone signal, wherein the microphone calibration module is further configured to set the gain based at least in part on a reference signal and a recorded noise signal; where the enhancement filter is further configured to be applied to one or more of the following: the input voice signal and an excitation signal derived from the input voice signal; further including a temporal enveloper shaper that can apply a temporal enhancement to the modified voice signal based at least in part on one or more envelopes of the modified voice signal; and where the temporal envelope shaper is further configured to sharpen peaks in the one or more envelopes of the modified voice signal to emphasize selected portions of the modified voice signal.

BRIEF DESCRIPTION OF THE DRAWINGS

Throughout the drawings, reference numbers may be reused to indicate correspondence between referenced elements. The drawings are provided to illustrate embodiments of the inventions described herein and not to limit the scope thereof.

DETAILED DESCRIPTION

I. Introduction

Existing voice intelligibility systems attempt to emphasize formants in speech, which can include resonant frequencies generated by a speaker's vocal chords that correspond to certain vowels and sonorant consonants. These existing systems typically employ filter banks having band pass filters for emphasizing the formants at different fixed frequency bands where formants are expected to occur. A problem with this approach is that formant locations can differ for different individuals. Further, a given individual's formant locations can also change over time. Fixed band pass filters may therefore emphasize frequencies that differ from a given individual's formant frequencies, resulting in impaired voice intelligibility.

This disclosure describes systems and methods for adaptively processing speech to improve voice intelligibility, among other features. In certain embodiments, these systems and methods can adaptively identify and track formant locations, thereby enabling formants to be emphasized as they change. As a result, these systems and methods can improve near-end intelligibility, even in noisy environments. The systems and methods can also enhance non-voiced speech, which can include speech generated without the vocal tract, such as transient speech. Some examples of non-voiced speech that can be enhanced include obstruent consonants such as plosives, fricatives, and affricates.

Many techniques can be used to adaptively track formant locations. Adaptive filtering is one such technique. In some embodiments, adaptive filtering employed in the context of linear predictive coding (LPC) can be used to track formants. For convenience, the remainder of this specification will describe adaptive formant tracking in the context of LPC. However, it should be understood that many other adaptive processing techniques can be used instead of LPC to track formant locations in certain embodiments. Some examples of techniques that can be used herein in place of or in addition to LPC include multiband energy demodulation, pole interaction, parameter-free non-linear prediction, and context-dependent phonemic information.

II. System Overview

Figure 1:
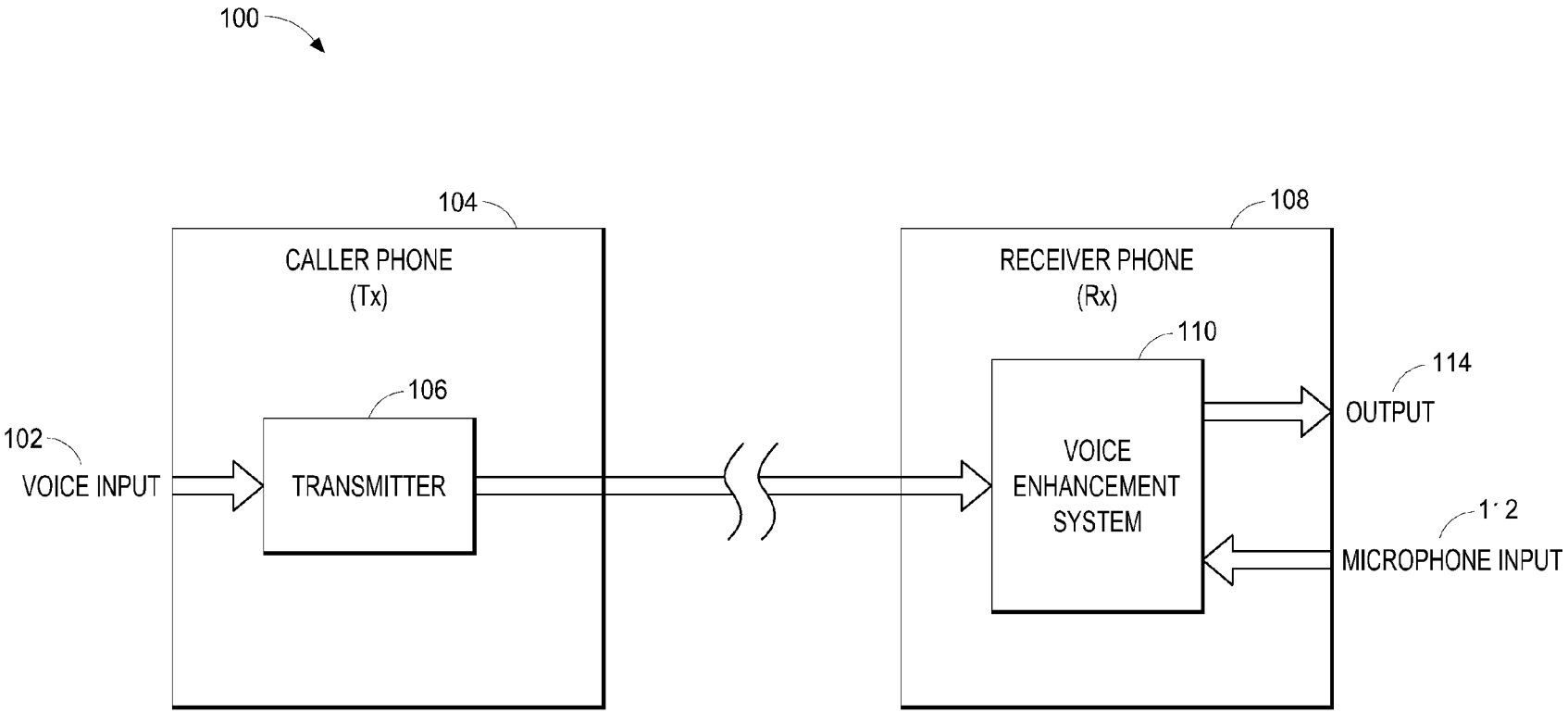
FIG. 1 illustrates an embodiment of a mobile phone environment that can implement a voice enhancement system.

FIG. 1 illustrates an embodiment of a mobile phone environment 100 that can implement a voice enhancement system 110. The voice enhancement system 110 can include hardware and/or software for increasing the intelligibility of the voice input signal 102. The voice enhancement system 110 can, for example, process the voice input signal 102 with a voice enhancement that emphasizes distinguishing characteristics of vocal sounds such as formants as well as non-vocal sounds (such as consonants, including, e.g., plosives and fricatives).

In the example mobile phone environment 100, a caller phone 104 and a receiver phone 108 are shown. The voice enhancement system 110 is installed in the receiver phone 108 in this example, although both phones may have a voice enhancement system in other embodiments. The caller phone 104 and the receiver phone 108 can be mobile phones, voice over Internet protocol (VoIP) phones, smart phones, landline phones, telephone and/or video conference phones, other computing devices (such as laptops or tablets), or the like. The caller phone 104 can be considered to be at the far-end of the mobile phone environment 100, and the receiver phone can be considered to be at the near-end of the mobile phone environment 100. When the user of the receiver phone 108 is speaking, the near and far-ends can reverse.

In the depicted embodiment, a voice input 102 is provided to the caller phone 104 by a caller. A transmitter 106 in the caller phone 104 transmits the voice input signal 102 to the receiver phone 108. The transmitter 106 can transmit the voice input signal 102 wirelessly or through landlines, or a combination of both. The voice enhancement system 110 in the receiver phone 108 can enhance the voice input signal 102 to increase voice intelligibility.

The voice enhancement system 110 can dynamically identify formants or other characterizing portions of the voice represented in the voice input signal 102. As a result, the voice enhancement system 110 can enhance the formants or other characterizing portions of the voice dynamically, even if the formants change over time or are different for different speakers. The voice enhancement system 110 can also adapt a degree to which the voice enhancement is applied to the voice input signal 102 based at least partly on environmental noise in a microphone input signal 112 detected using a microphone of the receiver phone 108. The environmental noise or content can include background or ambient noise. If the environmental noise increases, the voice enhancement system 110 can increase the amount of the voice enhancement applied, and vice versa. The voice enhancement can therefore at least partly track the amount of detected environmental noise. Similarly, the voice enhancement system 110 can also increase an overall gain applied to the voice input signal 102 based at least partly on the amount of environmental noise.

However, when less environmental noise is present, the voice enhancement system 110 can reduce the amount of the voice enhancement and/or gain increase applied. This reduction can be beneficial to the listener because the voice enhancement and/or volume increase can sound harsh or unpleasant when there are low levels of environmental noise. For instance, the voice enhancement system 110 can begin applying the voice enhancement to the voice input signal 102 once the environmental noise exceeds a threshold amount to avoid causing the voice to sound harsh in the absence of the environmental noise.

Thus, in certain embodiments, the voice enhancement system 110 transforms the voice input signal into an enhanced output signal 114 that can be more intelligible to a listener in the presence of varying levels of environmental noise. In some embodiments, the voice enhancement system 110 can also be included in the caller phone 104. The voice enhancement system 110 might apply the enhancement to the voice input signal 102 based at least partly on an amount of environmental noise detected by the caller phone 104. The voice enhancement system 110 can therefore be used in the caller phone 104, the receiver phone 108, or both.

Although the voice enhancement system 110 is shown being part of the phone 108, the voice enhancement system 110 could instead be implemented in any communication device. For instance, the voice enhancement system 110 could be implemented in a computer, router, analog telephone adapter, dictaphone, or the like. The voice enhancement system 110 could also be used in Public Address ("PA") equipment (including PA over Internet Protocol), radio transceivers, assistive hearing devices (e.g., hearing aids), speaker phones, and in other audio systems. Moreover, the voice enhancement system 110 can be implemented in any processor-based system that provides an audio output to one or more speakers.

Figure 2:
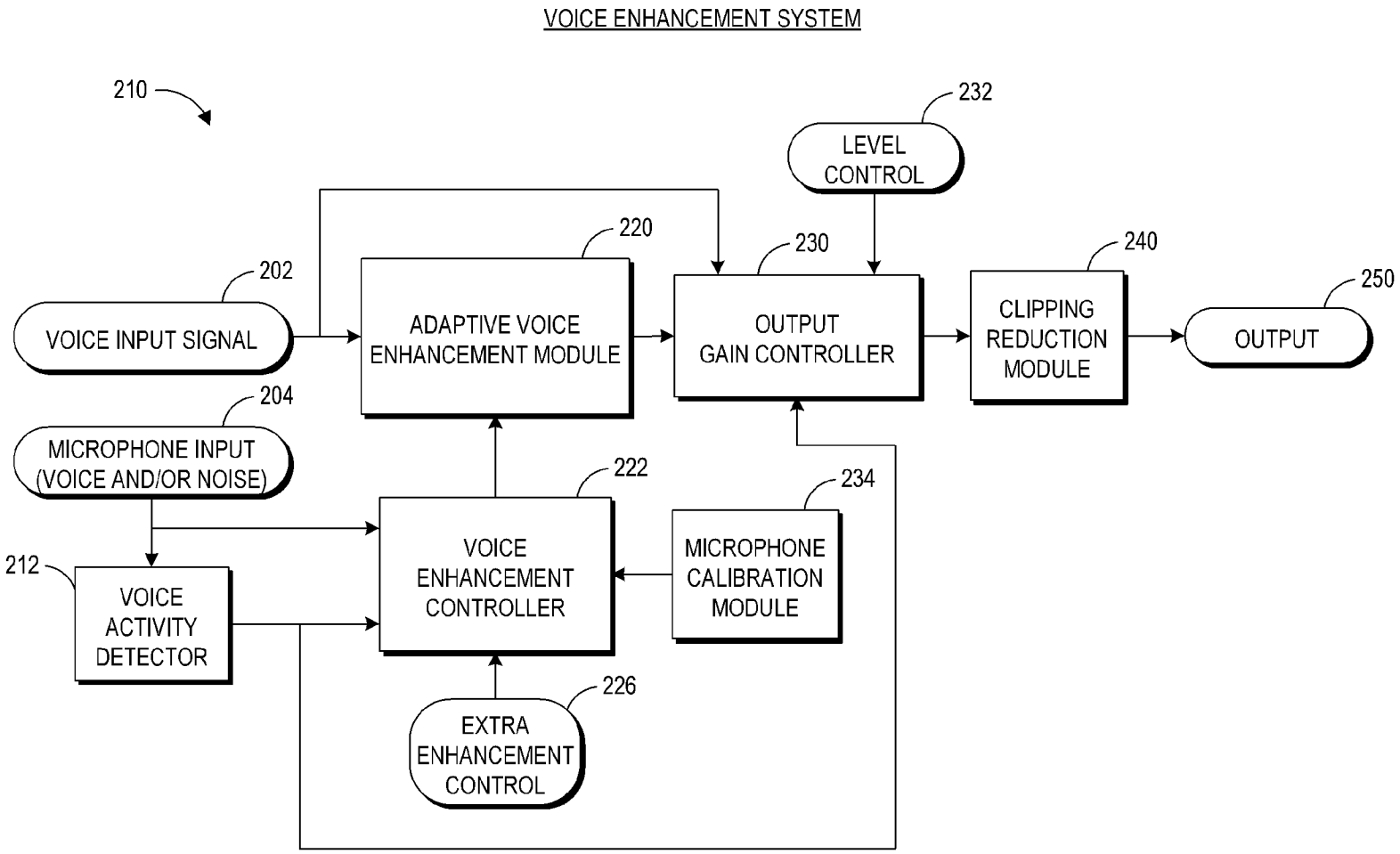
FIG. 2 illustrates a more detailed embodiment of a voice enhancement system.

FIG. 2 illustrates a more detailed embodiment of a voice enhancement system 210. The voice enhancement system 210 can implement some or all the features of the voice enhancement system 110 and can be implemented in hardware and/or software. The voice enhancement system 210 can be implemented in a mobile phone, cell phone, smart phone, or other computing device, including any of the devices mentioned above. The voice enhancement system 210 can adaptively track formants and/or other portions of a voice signal and can adjust enhancement processing based at least partly on a detected amount of environmental noise and/or a level of the input voice signal.

The voice enhancement system 210 includes an adaptive voice enhancement module 220. The adaptive voice enhancement module 220 can include hardware and/or software for adaptively applying a voice enhancement to a voice input signal 202 (e.g., received from a caller phone, in a hearing aid, or other device). The voice enhancement can emphasize distinguishing characteristics of vocal sounds in the voice input signal 202, including voiced and/or non-voiced sounds.

Advantageously, in certain embodiments the adaptive voice enhancement module 220 adaptively tracks formants so as to enhance proper formant frequencies for different speakers (e.g., individuals) or for the same speaker with changing formants over time. The adaptive voice enhancement module 220 can also enhance non-voiced portions of speech, including certain consonants or other sounds produced by portions of the vocal tract other than the vocal chords. In one embodiment, the adaptive voice enhancement module 220 enhances non-voiced speech by temporally shaping the voice input signal. These features are described in greater detail with respect to FIG. 3 below.

A voice enhancement controller 222 is provided that can control the level of the voice enhancement provided by the voice enhancement module 220. The voice enhancement controller 222 can provide an enhancement level control signal or value to the adaptive voice enhancement module 220 that increases or decreases the level of the voice enhancement applied. The control signal can adapt block by block or sample by sample as a microphone input signal 204 including environment noise increases and decreases.

In certain embodiments, the voice enhancement controller 222 adapts the level of the voice enhancement after a threshold amount of energy of the environmental noise in the microphone input signal 204 is detected. Above the threshold, the voice enhancement controller 222 can cause the level of the voice enhancement to track or substantially track the amount of environmental noise in the microphone input signal 204. In one embodiment, for example, the level of the voice enhancement provided above the noise threshold is proportional to a ratio of the energy (or power) of the noise to the threshold. In alternative embodiments, the level of the voice enhancement is adapted without using a threshold. The level of adaption of the voice enhancement applied by the voice enhancement controller 222 can increase exponentially or linearly with increasing environmental noise (and vice versa).

To ensure or attempt to ensure that the voice enhancement controller 222 adapts the level of the voice enhancement at about the same level for each device incorporating the voice enhancement system 210, a microphone calibration module 234 is provided. The microphone calibration module 234 can compute and store one or more calibration parameters that adjust a gain applied to the microphone input signal 204 to cause an overall gain of the microphone to be the same or about the same for some or all devices. The functionality of the microphone calibration module 234 is described in greater detail below with respect to FIG. 10.

Unpleasant effects can occur when the microphone of the receiving phone 108 is picking up the voice signal from the speaker output 114 of the phone 108. This speaker feedback can be interpreted as environmental noise by the voice enhancement controller 222, which can cause self-activation of the voice enhancement and hence modulation of the voice enhancement by the speaker feedback. The resulting modulated output signal can be unpleasant to a listener. A similar problem can occur when the listener talks, coughs, or otherwise emanates sound into the receiver phone 108 at the same time that the receiver phone 108 is outputting a voice signal received from the caller phone 104. In this double talk scenario with both speaker and listener talking (or emanating sounds) at the same time, the adaptive voice enhancement module 220 may modulate the remote voice input 202 based on the double talk. This modulated output signal can be unpleasant to a listener.

To combat these effects, a voice activity detector 212 is provided in the depicted embodiment. The voice activity detector 212 can detect voice or other sounds emanating from a speaker in the microphone input signal 204 and can distinguish voice from environmental noise. When the microphone input signal 204 includes environmental noise, the voice activity detector 212 can allow the voice enhancement 222 to adjust the amount of voice enhancement provided by the adaptive voice enhancement module 220 based on the current measured environmental noise. However, when the voice activity detector 212 detects voice in the microphone input signal 204, the voice activity detector 212 can use a previous measurement of the environmental noise to adjust the voice enhancement.

The depicted embodiment of the voice enhancement system 210 includes an extra enhancement control 226 for further adjusting the amount of control provided by the voice enhancement controller 222. The extra enhancement control 226 can provide an extra enhancement control signal to the voice enhancement controller 222 that can be used as a value below which the enhancement level cannot go below. The extra enhancement control 226 can be exposed to a user via a user interface. This control 226 might also allow a user to increase the enhancement level beyond that determined by the voice enhancement controller 222. In one embodiment, the voice enhancement controller 222 can add the extra enhancement from the extra enhancement control 226 to the enhancement level determined by the voice enhancement controller 222. The extra enhancement control 226 might be particularly useful for the hearing impaired who want more voice enhancement processing or want voice enhancement processing to be applied frequently.

The adaptive voice enhancement module 220 can provide an output voice signal to an output gain controller 230. The output gain controller 230 can control the amount of overall gain applied to the output signal of the voice enhancement module 220. The output gain controller 230 can be implemented in hardware and/or software. The output gain controller 230 can adjust the gain applied to the output signal based at least partly on the level of the noise input 204 and on the level of the voice input 202. This gain can be applied in addition to any user-set gain, such as a volume control of phone. Advantageously, adapting the gain of the audio signal based on the environmental noise in the microphone input signal 204 and/or voice input 202 level can help a listener further perceive the voice input signal 202.

An adaptive level control 232 is also shown in the depicted embodiment, which can further adjust the amount of gain provided by the output gain controller 230. A user interface could also expose the adaptive level control 232 to the user. Increasing this control 232 can cause the gain of the controller 230 to increase more as the incoming voice input 202 level decreases or as the noise input 204 increases. Decreasing this control 232 can cause the gain of the controller 230 to increase less as the incoming voice input signal 202 level decreases or as the noise input 204 decreases.

In some cases, the gains applied by the voice enhancement module 220, the voice enhancement controller 222, and/or the output gain controller 230 can cause the voice signal to clip or saturate. Saturation can result in harmonic distortion that is unpleasant to a listener. Thus, in certain embodiments, a distortion control module 240 is also provided. The distortion control module 240 can receive the gain-adjusted voice signal of the output gain controller 230. The distortion control module 240 can include hardware and/or software that controls the distortion while also at least partially preserving or even increasing the signal energy provided by the voice enhancement module 220, the voice enhancement controller 222, and/or the output gain controller 230. Even if clipping is not present in the signal provided to the distortion control module 240, in some embodiments the distortion control module 240 induces at least partial saturation or clipping to further increase loudness and intelligibility of the signal.

In certain embodiments, the distortion control module 240 controls distortion in the voice signal by mapping one or more samples of the voice signal to an output signal having fewer harmonics than a fully-saturated signal. This mapping can track the voice signal linearly or approximately linearly for samples that are not saturated. For samples that are saturated, the mapping can be a nonlinear transformation that applies a controlled distortion. As a result, in certain embodiments, the distortion control module 240 can allow the voice signal to sound louder with less distortion than a fully-saturated signal. Thus, in certain embodiments, the distortion control module 240 transforms data representing a physical voice signal into data representing another physical voice signal with controlled distortion.

Various features of the voice enhancement system 110 and 210 can include the corresponding functionality of the same or similar components described in U.S. Pat. No. 8,204,742, filed Sep. 14, 2009, titled "Systems for Adaptive Voice Intelligibility Processing," the disclosure of which is hereby incorporated by reference in its entirety. In addition, the voice enhancement system 110 or 210 can include any of the features described in U.S. Pat. No. 5,459,813 ("the '813 patent"), filed Jun. 23, 1993, titled "Public Address Intelligibility System," the disclosure of which is hereby incorporated by reference in its entirety. For example, some embodiments of the voice enhancement system 110 or 210 can implement the fixed formant tracking features described in the '813 patent while implementing some or all of the other features described herein (such as temporal enhancement of non-voiced speech, voice activity detection, microphone calibration, combinations of the same, or the like). Similarly, other embodiments of the voice enhancement system 110 or 210 can implement the adaptive formant tracking features described herein without implementing some or all of the other features described herein.

III. Adaptive Formant Tracking Embodiments

Figure 3:
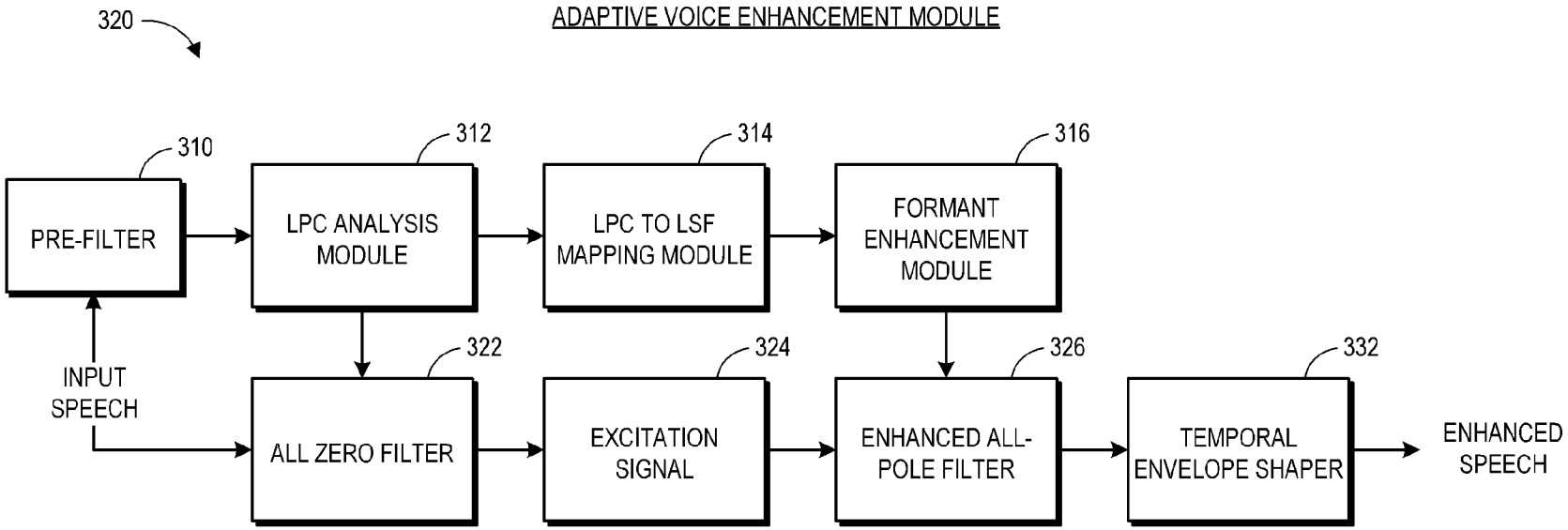
FIG. 3 illustrates an embodiment of an adaptive voice enhancement module.

With reference to FIG. 3, an embodiment of an adaptive voice enhancement module 320 is shown. The adaptive voice enhancement module 320 is a more detailed embodiment of the adaptive voice enhancement module 220 of FIG. 2. Thus, the adaptive voice enhancement module 320 can be implemented by either the voice enhancement system 110 or 210. Accordingly, the adaptive voice enhancement module 320 can be implemented in software and/or hardware. The adaptive voice enhancement module 320 can advantageously track voiced speech such as formants adaptively and can also temporally enhance non-voiced speech.

In the adaptive voice enhancement module 320, input speech is provided to a pre-filter 310. This input speech corresponds to the voice input signal 202 described above. The pre-filter 310 may be a high-pass filter or the like that attenuates certain bass frequencies. For instance, in one embodiment, the pre-filter 310 attenuates frequencies below about 750 Hz, although other cutoff frequencies may be chosen. By attenuating spectral energy at low frequencies such as those below about 750 Hz, the pre-filter 310 can create more headroom for subsequent processing, enabling better LPC analysis and enhancement. Similarly, in other embodiments, the pre-filter 310 can include a low-pass filter instead of or in addition to a high pass filter, which attenuates higher frequencies and thereby provides additional headroom for gain processing. The pre-filter 310 can also be omitted in some implementations.

The output of the pre-filter 310 is provided to an LPC analysis module 312 in the depicted embodiment. The LPC analysis module 312 can apply a linear prediction technique to spectrally analyze and identify formant locations in a frequency spectrum. Although described herein as identifying formant locations, more generally, the LPC analysis module 312 can generate coefficients that can represent a frequency or power spectral representation of the input speech. This spectral representation can include peaks that correspond to formants in the input speech. The identified formants may correspond to bands of frequencies, rather than just the peaks themselves. For example, a formant said to be located at 800 Hz may actually include a spectral band around 800 Hz. By producing these coefficients having this spectral representation, the LPC analysis module 312 can adaptively identify formant locations as they change over time in the input speech. Subsequent components of the adaptive voice enhancement module 320 are therefore able to adaptively enhance these formants.

In one embodiment, the LPC analysis module 312 uses a predictive algorithm to generate coefficients of an all-pole filter, as all-pole filter models can accurately model formant locations in speech. In one embodiment, an autocorrelation method is used to obtain coefficients for the all-pole filter. One particular algorithm that can be used to perform this analysis, among others, is the Levinson-Durbin algorithm. The Levinson-Durbin algorithm generates coefficients of a lattice filter, although direct form coefficients may also be generated. The coefficients can be generated for a block of samples rather than for each sample to improve processing efficiency.

The coefficients generated by LPC analysis tend to be sensitive to quantization noise. A very small error in the coefficients can distort the entire spectrum or make the filter unstable. To reduce the effects of quantization noise on the all-pole filter, a mapping or transformation from the LPC coefficients to line spectral pairs (LSPs, also called line spectral frequencies (LSF)) can be performed by a mapping module 314. The mapping module 314 can produce a pair of coefficients for each LPC coefficient. Advantageously, in certain embodiments, this mapping can produce LSPs that are on the unit circle (in the Z-transform domain), improving the stability of the all-pole filter. Alternatively, or in addition to LSPs as a way to address coefficient sensitivity to noise, the coefficients can be represented using Log Area Ratios (LAR) or other techniques.

Figure 4:
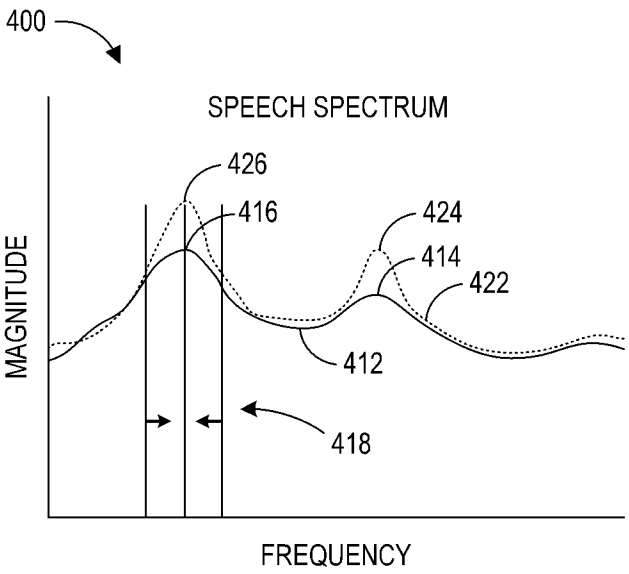
FIG. 4 illustrates an example plot of a speech spectrum.

In certain embodiments, a formant enhancement module 316 receives the LSPs and performs additional processing to produce an enhanced all-pole filter 326. The enhanced all-pole filter 326 is one example of an enhancement filter that can be applied to a representation of the input audio signal to produce a more intelligible audio signal. In one embodiment, the formant enhancement module 316 adjusts the LSPs in a manner that emphasizes spectral peaks at the formant frequencies. Referring to FIG. 4, an example plot 400 is shown including a frequency magnitude spectrum 412 (solid line) having formant locations identified by peaks 414 and 416. The formant enhancement module 316 can adjust these peaks 414, 416 to produce a new spectrum 422 (approximated by the dashed line) having peaks 424, 426 in the same or substantially same formant locations but with higher gain. In one embodiment, the formant enhancement module 316 increases the gain of the peaks by decreasing the distance between line spectral pairs, as illustrated by vertical bars 418.

In certain embodiments, line spectral pairs corresponding to the formant frequency are adjusted so as to represent frequencies that are closer together, thereby increasing the gain of each peak. While the linear prediction polynomial has complex roots anywhere within the unit circle, in some embodiments the line spectral polynomial has roots only on the unit circle. Thus, the line spectral pairs may have several properties superior for direct quantization of LPCs. Since the roots are interleaved in some implementations, stability of the filter can be achieved if the roots are monotonically increasing. Unlike LPC coefficients, LSPs may not be over sensitive to quantization noise and therefore stability may be achieved. The closer two roots are, the more resonant the filter may be at the corresponding frequency. Thus, decreasing the distance between two roots (one line spectral pair) corresponding to the LPC spectral peak can advantageously increase the filter gain at that formant location.

The formant enhancement module 316 can decrease the distance between the peaks in one embodiment by applying a modulation factor $\delta$ to each root using a phase-change operation such as multiplication by $e^{j\Omega\delta}$. Changing the value of the quantity $\delta$ can cause the roots to move along the unit circle closer together or farther apart. Thus, for a pair of LSP roots, a first root can be moved closer to the second root by applying a positive value of the modulation factor $\delta$ and the second root can be moved closer to the first root by applying a negative value of $\delta$. In some embodiments, the distance between the roots can be reduced by a certain amount to achieve the desired enhancement, such as a distance reduction of about 10%, or about 25%, or about 30%, or about 50%, or some other value.

Adjustment of the roots can also be controlled by the voice enhancement controller 222. As described above with respect to FIG. 2, the voice enhancement module 222 can adjust the amount of voice intelligibility enhancement that is applied based on the microphone input signal's 204 noise level. In one embodiment, the voice enhancement controller 222 outputs a control signal to the adaptive voice enhancement controller 220 that the formant enhancement module 316 can use to adjust the amount of formant enhancement applied to the LSP roots. In one embodiment, the formant enhancement module 316 adjusts the modulation factor $\delta$ based on the control signal. Thus, a control signal that indicates more enhancement should be applied (e.g., due to more noise) can cause the formant enhancement module 316 to change the modulation factor $\delta$ to bring the roots closer together, and vice versa.

Referring again to FIG. 3, the formant enhancement module 316 can map the adjusted LSPs back to LPC coefficients (lattice or direct form) to produce the enhanced all-pole filter 326. However, in some implementations, this mapping does not need to be performed, but rather, the enhanced all-pole filter 326 can be implemented with the LSPs as coefficients.

In order to enhance the input speech, in certain embodiments the enhanced all-pole filter 326 operates on an excitation signal 324 that is synthesized from the input speech signal. This synthesis is performed in certain embodiments by applying an all-zero filter 322 to the input speech to produce the excitation signal 324. The all-zero filter 322 is created by the LPC analysis module 312 and can be an inverse filter that is the inverse of the all-pole filter created by the LPC analysis module 312. In one embodiment, the all-zero filter 322 is also implemented with LSPs calculated by the LPC analysis module 312. By applying the inverse of an all-pole filter to the input speech and then applying the enhanced all-pole filter 326 to the inverted speech signal (the excitation signal 324), the original input speech signal can be recovered (at least approximately) and enhanced. As the coefficients for the all-zero filter 322 and the enhanced all-pole filter 326 can change from block to block (or even sample to sample), formants in the input speech can be adaptively tracked and emphasized, thereby improving speech intelligibility, even in noisy environments. Thus, the enhanced speech is generated using an analysis-synthesis technique in certain embodiments.

Figure 5:
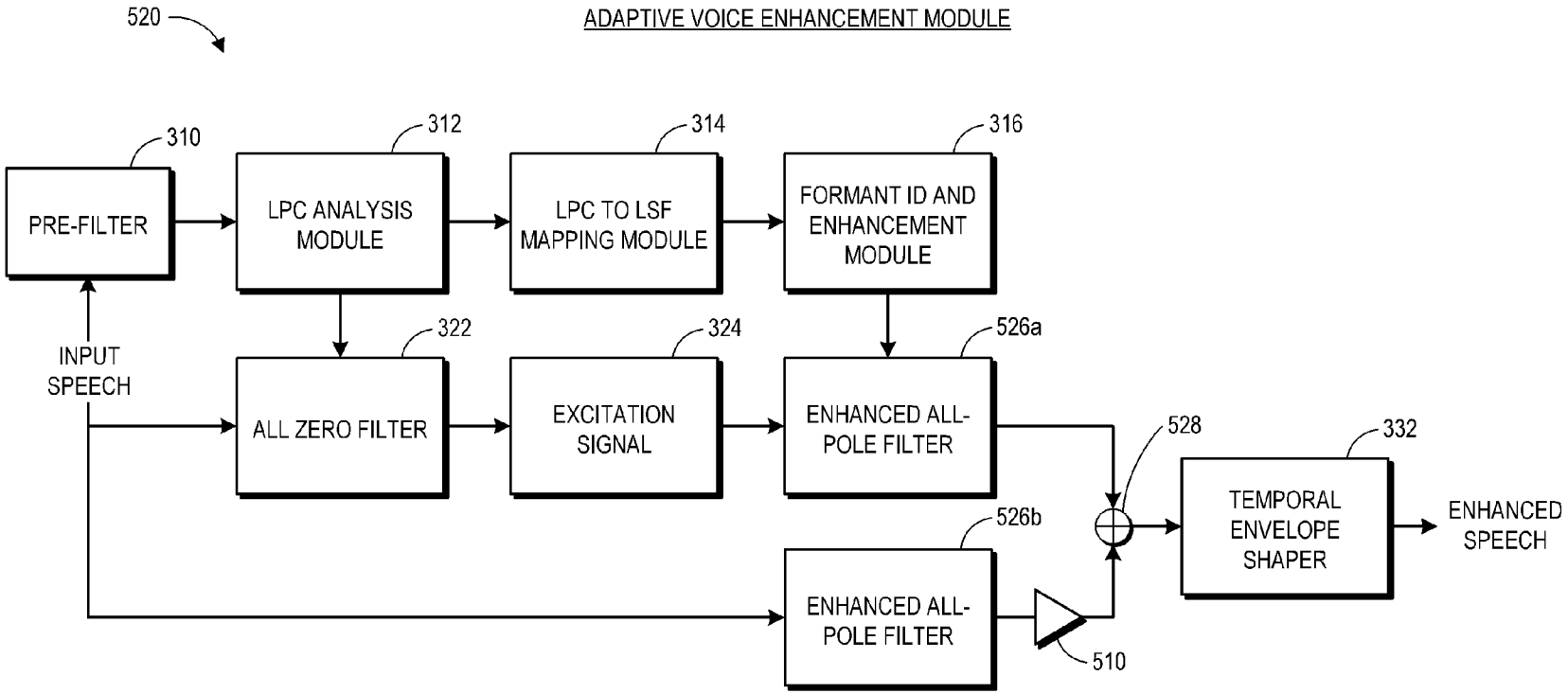
FIG. 5 illustrates another embodiment of an adaptive voice enhancement module.

FIG. 5 depicts another embodiment of an adaptive voice enhancement module 520 that includes all the features of the adaptive voice enhancement module 320 of FIG. 3 plus additional features. In particular, in the depicted embodiment, the enhanced all-pole filter 326 of FIG. 3 is applied twice: once to the excitation signal 324 (526*a*), and once to the input speech (526*b*). Applying the enhanced all-pole filter 526*b* to the input speech can produce a signal that has a spectrum that is approximately the square of the input speech's spectrum. This approximately spectrum-squared signal is added with the enhanced excitation signal output by a combiner 528 to produce an enhanced speech output. An optional gain block 510 can be provided to adjust the amount of spectrum squared signal applied. (Although shown as being applied to the spectrum squared signal, the gain could instead be applied to the output of the enhanced all-pole filter 526*a*, or to the output of both filters 526*a*, 526*b*.) A user interface control may be provided to allow a user, such as the manufacturer of a device that incorporates the adaptive voice enhancement module 320 or the end user of the device to adjust the gain 510. More gain applied to the spectrum squared signal can increase harshness of the signal, which may increase intelligibility in particularly noisy environments but which may sound too harsh in less noisy environments. Thus, providing a user control can enable adjustment of the perceived harshness of the enhanced speech signal. This gain 510 can also be automatically controlled by the voice enhancement controller 222 based on the environmental noise input in some embodiments.

Fewer than all the blocks shown in the adaptive voice enhancement modules 320 or 520 may be implemented in certain embodiments. Additional blocks or filters may also be added to the adaptive voice enhancement modules 320 or 520 in other embodiments.

IV. Temporal Envelope Shaping Embodiments

The voice signal modified by the enhanced all-pole filter 326 in FIG. 3 or as output by the combiner 528 in FIG. 5 can be provided to a temporal envelope shaper 332 in some embodiments. The temporal envelope shaper 332 can enhance non-voiced speech (including transient speech) via temporal envelope shaping in the time domain. In one embodiment, the temporal envelope shaper 332 enhances mid-range frequencies, including frequencies below about 3 kHz (and optionally above bass frequencies). The temporal envelope shaper 332 may enhance frequencies other than mid-range frequencies as well.

In certain embodiment, the temporal envelope shaper 332 can enhance temporal frequencies in the time domain by first detecting an envelope from the output signal of the enhanced all-pole filter 326. The temporal envelope shaper 332 can detect the envelope using any of a variety of methods. One example approach is maximum value tracking, in which the temporal envelope shaper 332 can divide the signal into windowed sections and then select a maximum or peak value from each of the windows sections. The temporal envelope shaper 332 can connect the maximum values together with a line or curve between each value to form the envelope. In some embodiments, to increase the speech intelligibility, the temporal envelop shaper 332 can divide the signal into an appropriate number of frequency bands and perform different shaping for each band.

Example window sizes can include 64, 128, 256, or 512 samples, although other window sizes may also be chosen (including window sizes that are not a power of 2). In general, larger window sizes can extend the temporal frequency to be enhanced to lower frequencies. Further, other techniques can be used to detect the signal's envelope, such as Hilbert Transform-related techniques and self-demodulating techniques (e.g., squaring and low-pass filtering the signal).

Once the envelope has been detected, the temporal envelope shaper 332 can adjust the shape of the envelope to selectively sharpen or smooth aspects of the envelope. In a first stage, the temporal envelope shaper 332 can compute gains based on characteristics of the envelope. In a second stage, the temporal envelope shaper 332 can apply the gains to samples in the actual signal to achieve the desired effect. In one embodiment, the desired effect is to sharpen the transient portions of the speech to emphasize non-vocalized speech (such as certain consonants like "s" and "t"), thereby increasing speech intelligibility. In other applications, it may be useful to smooth the speech to thereby soften the speech.

Figure 6:
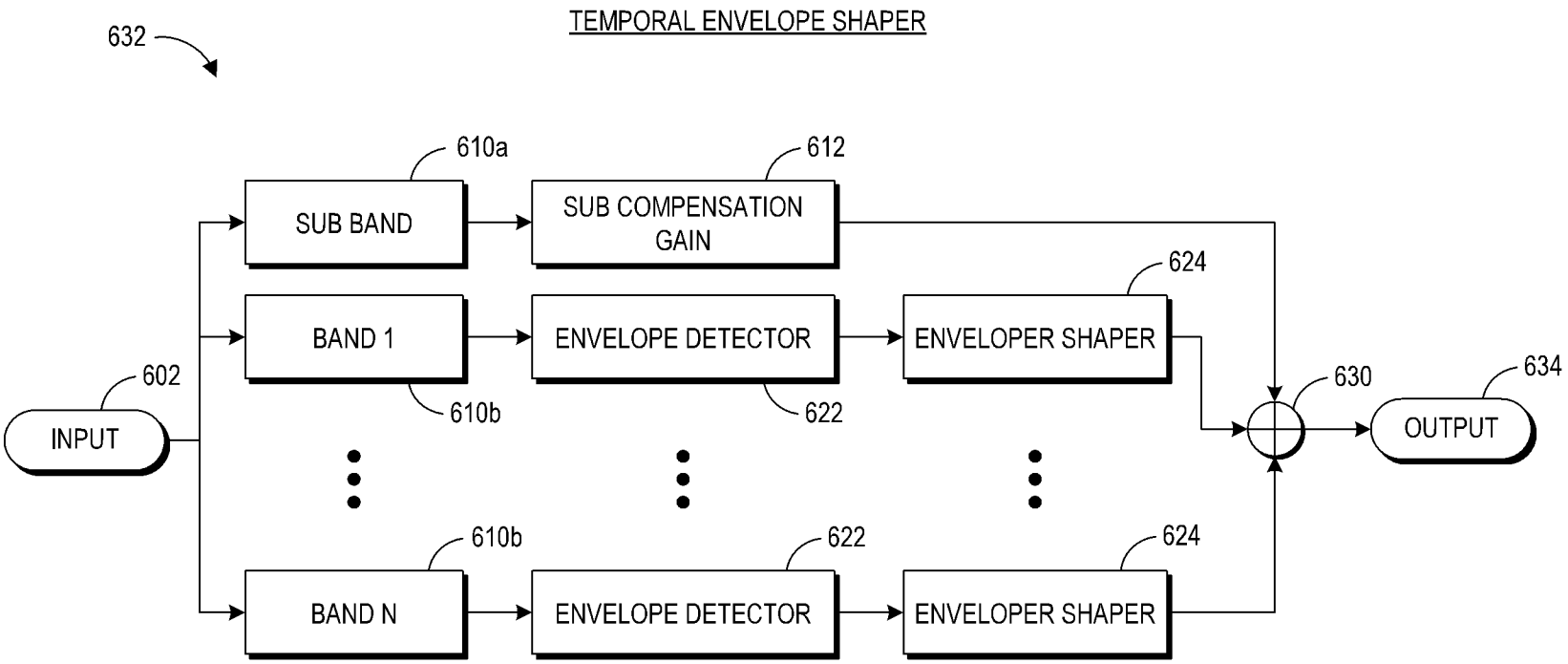
FIG. 6 illustrates an embodiment of a temporal envelope shaper.

FIG. 6 illustrates a more detailed embodiment of a temporal envelope shaper 632 that can implement the features of the temporal envelope shaper 332 of FIG. 3. The temporal envelope shaper 632 can also be used for different applications, independent of the adaptive voice enhancement modules described above.

The temporal envelope shaper 632 receives an input signal 602 (e.g., from the filter 326 or the combiner 528). The temporal envelope shaper 632 then subdivides the input signal 602 into a plurality of bands using band pass filters 610 or the like. Any number of bands can be chosen. As one example, the temporal envelope shaper 632 can divide the input signal 602 into four bands, including a first band from about 50 Hz to about 200 Hz, a second band from about 200 Hz to about 4 kHz, a third band from about 4 kHz to about 10 kHz, and a fourth band from about 10 kHz to about 20 kHz. In other embodiments, the temporal enveloper shaper 332 does not divide the signal into bands but instead operates on the signal as a whole.

The lowest band can be a bass or sub band obtained using sub band pass filter 610*a*. The sub band can correspond to frequencies typically reproduced in a subwoofer. In the example above, the lowest band is about 50 Hz to about 200 Hz. The output of this sub band pass filter 610*a* is provided to a sub compensation gain block 612, which applies a gain to the signal in the sub band. As will be described in detail below, gains may be applied to the other bands to sharpen or emphasize aspects of the input signal 602. However, applying such gains can increase the energy in bands 610*b* other than the sub band 610*a*, resulting in a potential reduction in bass output. To compensate for this reduced bass effect, the sub compensation gain block 612 can apply a gain to the sub band 610*a* based on the amount of gain applied to the other bands 610*b*. The sub compensation gain can have a value that is equal to or approximately equal to the difference in energy between the original input signal 602 (or the envelope thereof) and the sharpened input signal. The sub compensation gain can be calculated by the gain block 612 by summing, averaging, or otherwise combining the added energy or gains applied to the other bands 610*b*. The sub compensation gain can also be calculated by the gain block 612 selecting the peak gain applied to one of the bands 610*b* and using this value or the like for the sub compensation gain. In another embodiment, however, the sub compensation gain is a fixed gain value. The output of the sub compensation gain block 612 is provided to a combiner 630.

The output of each of the other band pass filter 610*b* can be provided to an envelope detector 622 that implements any of the envelope detection algorithms described above. For example, the envelope detector 622 can perform maximum value tracking or the like. The output of the envelope detectors 622 can be provided to envelope shapers 624, which can adjust the shape of the envelope to selectively sharpen or smooth aspects of the envelope. Each of the envelope shapers 624 provides an output signal to the combiner 630, which combines the output of each envelope shaper 624 and the sub compensation gain block 612 to provide an output signal 634.

Figure 7:
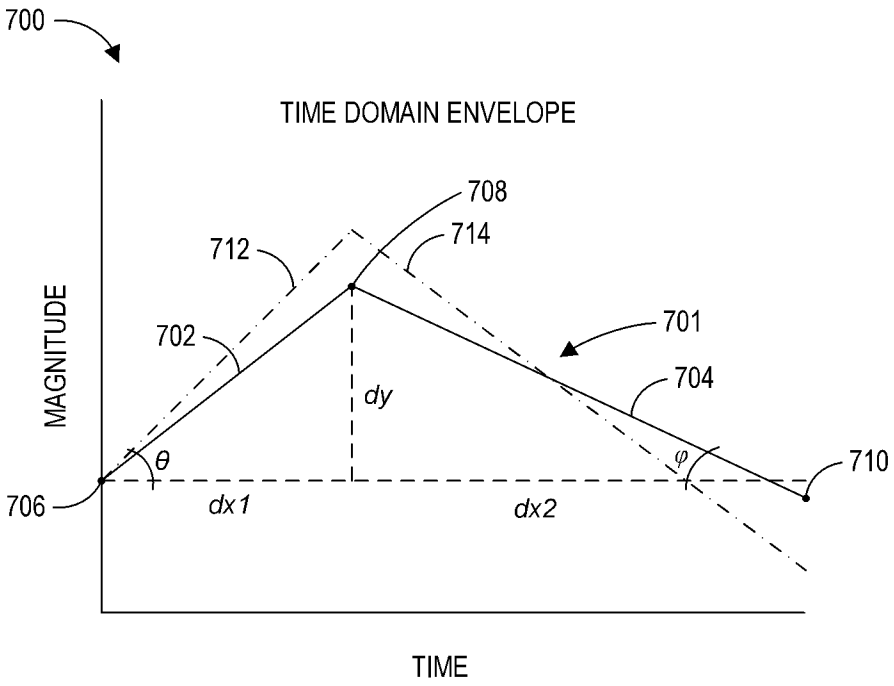
FIG. 7 illustrates an example plot of a time domain speech envelope.
Figure 8:
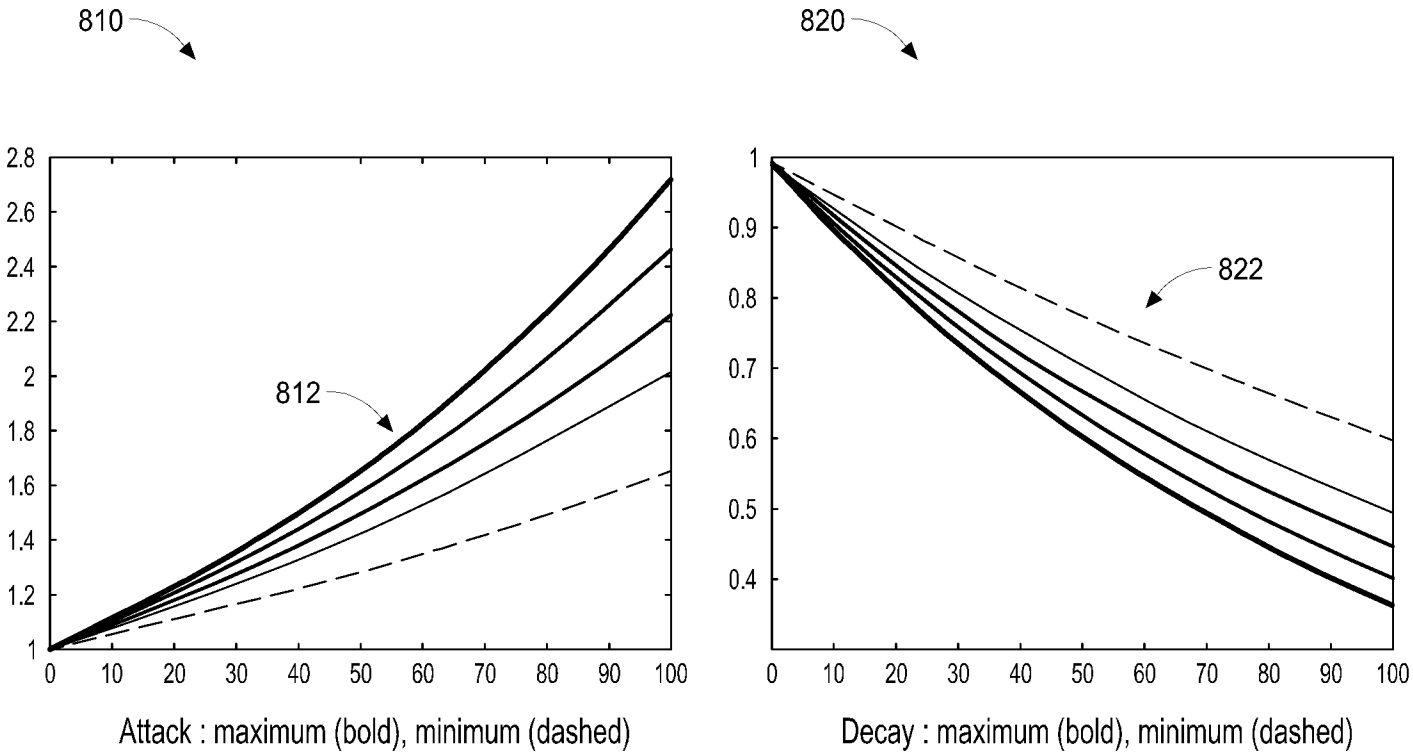
FIG. 8 illustrates example plots of attack and decay envelopes.

The sharpening effect provided by the enveloper shapers 624 can be achieved by manipulating the slope of the envelope in each band (or the signal as a whole if not subdivided), as shown in FIGS. 7 and 8. Referring to FIG. 7, an example plot 700 is shown depicting a portion of a time domain envelope 701. In the plot 700, the time domain envelope 701 includes two portions, a first portion 702 and a second portion 704. The first portion 702 has a positive slope, while the second portion 704 has a negative slope. Thus, the two portions 702, 704 form a peak 708. Points 706, 708, and 710 on the envelope represent peak values detected from windows or frames by the maximum value envelope detector described above. The portions 702, 704 represent lines used to connect the peak points 706, 708, 710, thereby forming the envelope 701. While a peak 708 is shown in this envelope 701, other portions (not shown) of the envelope 701 may instead have an inflection point or zero slope. The analysis described with respect to the example portion of the envelope 701 can also be implemented for such other portions of the envelope 701.

The first portion 702 of the envelope 701 forms an angle θ with the horizontal. The steepness of this angle can reflect whether the envelope 701 portions 702, 704 represent a transient portion of a speech signal, with steeper angles being more indicative of a transient. Similarly, the second portion 702 of the envelope 701 forms an angle ϕ with the horizontal. This angle also reflects the likelihood of a transient being present, with a higher angle being more indicative of a transient. Thus, increasing one or both of the angles θ, ϕ can effectively sharpen or emphasize the transient, and particularly increasing ϕ can result in a drier sound (e.g., a sound with less reverb) since the reflections of the sound may be decreased.

The angles can be increased by adjusting the slope of each of the lines formed by portions 702, 704 to produce a new envelope having steeper or sharpened portions 712, 714. The slope of the first portion 702 may be represented as dy/dx1, as shown in the FIG. 7, while the slope of the second portion 704 may be represented as dy/dx2 as shown. A gain can be applied to increase the absolute value of each slope (e.g., positive increase for dy/dx1 and negative increase for dy/dx2). This gain can be depend on the value of each angle θ, ϕ. To sharpen the transient, in certain embodiments, the gain value is increased along with positive slope and decreased in negative slope. The amount of gain adjustment provided to the first portion 702 of the envelope may, but need not, be the same as that applied to the second portion 704. In one embodiment, the gain for the second portion 704 is greater in absolute value than the gain applied to the first portion 702 to thereby further sharpen the sound. The gain may be smoothed for samples at the peak to reduce artifacts due to the abrupt transition from positive to negative gain. In certain embodiments, a gain is applied to the envelope whenever the angles described above are below a threshold. In other embodiments, the gain is applied whenever the angles are above a threshold. The computed gain (or gains for multiple samples and/or multplie bands) can constitute temporal enhancement parameters that sharpen peaks in the signal and thereby enhance selected consonants or other portions of the audio signal.

An example gain equation with smoothing that can implement these features is the following: gain=exp (gFactor*delta*(i−mBand→prev_maxXL/dx)* (mBand→mGainoffset+Offsetdelta*(i−mBand→prev_maxXL)). In this example equation, the gain is an exponential function of the change in angle because the envelope and the angles are calculated in logarithmic scale. The quantity gFactor controls the rate of attack or decay. The quantity (i−mBand→prev_maxXL/dx) represents the slope of the envelope, while the following portion of the gain equation represents a smoothing functions that starts from a previous gain and ends with the current gain: (mBand→mGainoffset+Offsetdelta*(i−mBand→prev_maxXL)). Since the human auditory system is based on a logarithmic scale, the exponential function can help listeners better distinguish the transient sounds.

The attack/decay function of the quantity gFactor is further illustrated in FIG. 8, where different levels of increasing attack slopes 812 are shown in a first plot 810 and different levels of decreasing decay slopes 822 are shown in a second plot 820. The attack slopes 812 can be increased in slope as described above to emphasize transient sounds, corresponding to the steeper first portion 712 of FIG. 7. Likewise, the decay slopes 822 can be decreased in slope as described above to further emphasize transient sounds, corresponding to the steeper second portion 714 of FIG. 7.

V. Example Voice Detection Process

Figure 9:
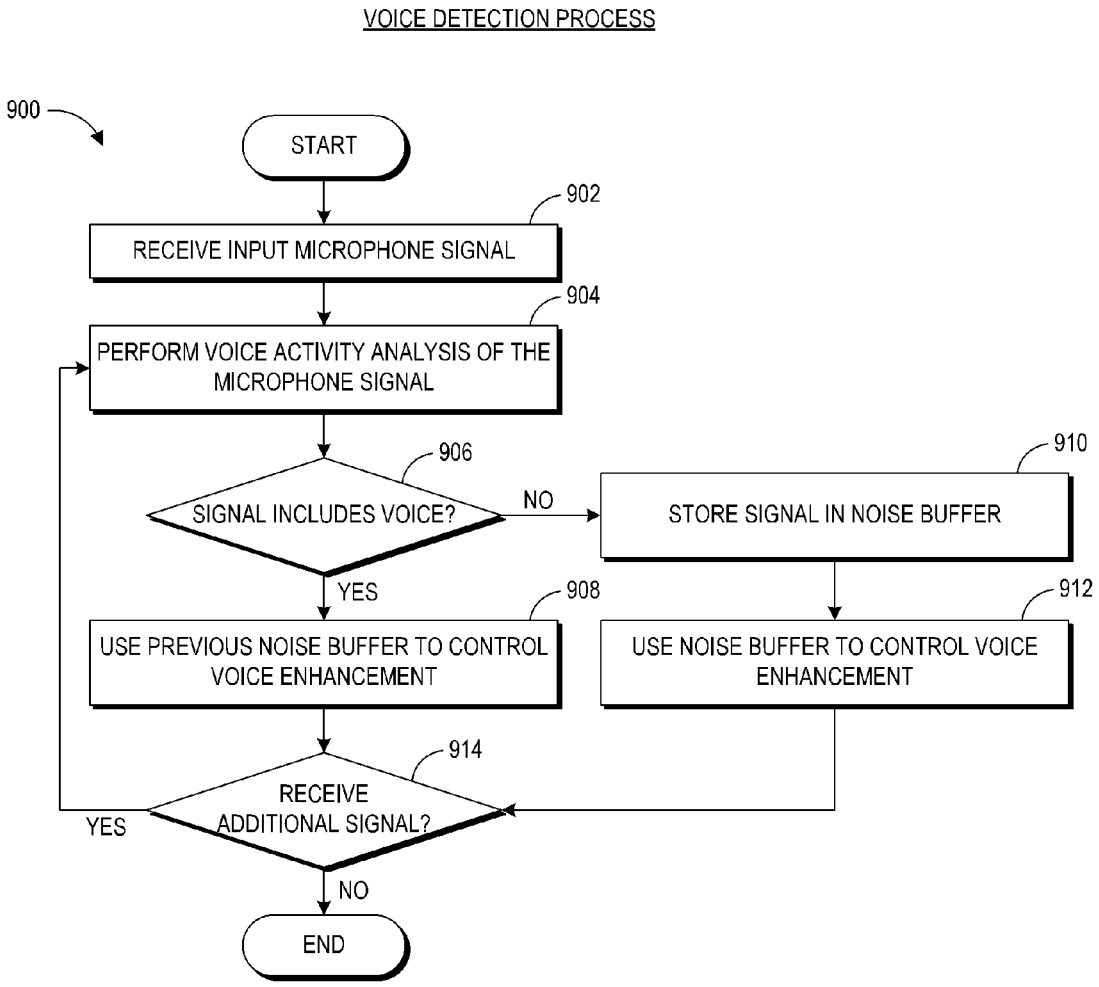
FIG. 9 illustrates an embodiment of a voice detection process.

FIG. 9 illustrates an embodiment of a voice detection process 900. The voice detection process 900 can be implemented by either of the voice enhancement systems 110, 210 described above. In one embodiment, the voice detection process 900 is implemented by the voice activity detector 212.

The voice detection process 900 detects voice in an input signal, such as the microphone input signal 204. If the input signal includes noise rather than voice, the voice detection process 900 allows the amount of voice enhancement to be adjusted based on the current measured environmental noise. However, when the input signal includes voice, the voice detection process 900 can cause a previous measurement of the environmental noise to be used to adjust the voice enhancement. Using the previous measure of the noise can advantageously avoid adjusting the voice enhancement based on a voice input while still enabling the voice enhancement to adapt to environmental noise conditions.

At block 902 of the process 900, the voice activity detector 212 receives an input microphone signal. At block 904, the voice activity detector 212 performs a voice activity analysis of the microphone signal. The voice activity detector 212 can use any of a variety of techniques to detect voice activity. In one embodiment, the voice activity detector 212 detects noise activity, rather than voice, and infers that periods of non-noise activity correspond to voice. The voice activity detector 212 can use any combination of the following techniques or the like to detect voice and/or noise: statistical analysis of the signal (using, e.g., standard deviation, variance, etc.), a ratio of lower band energy to higher band energy, a zero crossing rate, spectral flux or other frequency domain approaches, or autocorrelation. Further, in some embodiments, the voice activity detector 212 detects noise using some or all of the noise detection techniques described in U.S. Pat. No. 7,912,231, filed Apr. 21, 2006, titled "Systems and Methods for Reducing Audio Noise," the disclosure of which is hereby incorporated by reference in its entirety.

If the signal includes voice, as determined at decision block 906, the voice activity detector 212 causes the voice enhancement controller 222 to use a previous noise buffer to control the voice enhancement of the adaptive voice enhancement module 220. The noise buffer can include one or more blocks of noise samples of the microphone input signal 204 saved by the voice activity detector 212 or voice enhancement controller 222. A previous noise buffer, saved from a previous portion of the input signal 204, can be used under the assumption that the environmental noise has not changed significantly since the time that the previous noise samples were stored in the noise buffer. Because pauses in conversation frequently occur, this assumption may be accurate in many instances.

On the other hand, if the signal does not include voice, the voice activity detector 212 causes the voice enhancement controller 222 to use a current noise buffer to control the voice enhancement of the adaptive voice enhancement module 220. The current noise buffer can represent one or more most recently-received blocks of noise samples. The voice activity detector 212 determines at block 914 whether additional signal has been received. If so, the process 900 loops back to block 904. Otherwise, the process 900 ends.

Thus, in certain embodiments, the voice detection process 900 can mitigate the undesirable effects of voice input modulating or otherwise self-activating the level of the voice intelligibility enhancement applied to the remote voice signal.

VI. Example Microphone Calibration Process

Figure 10:
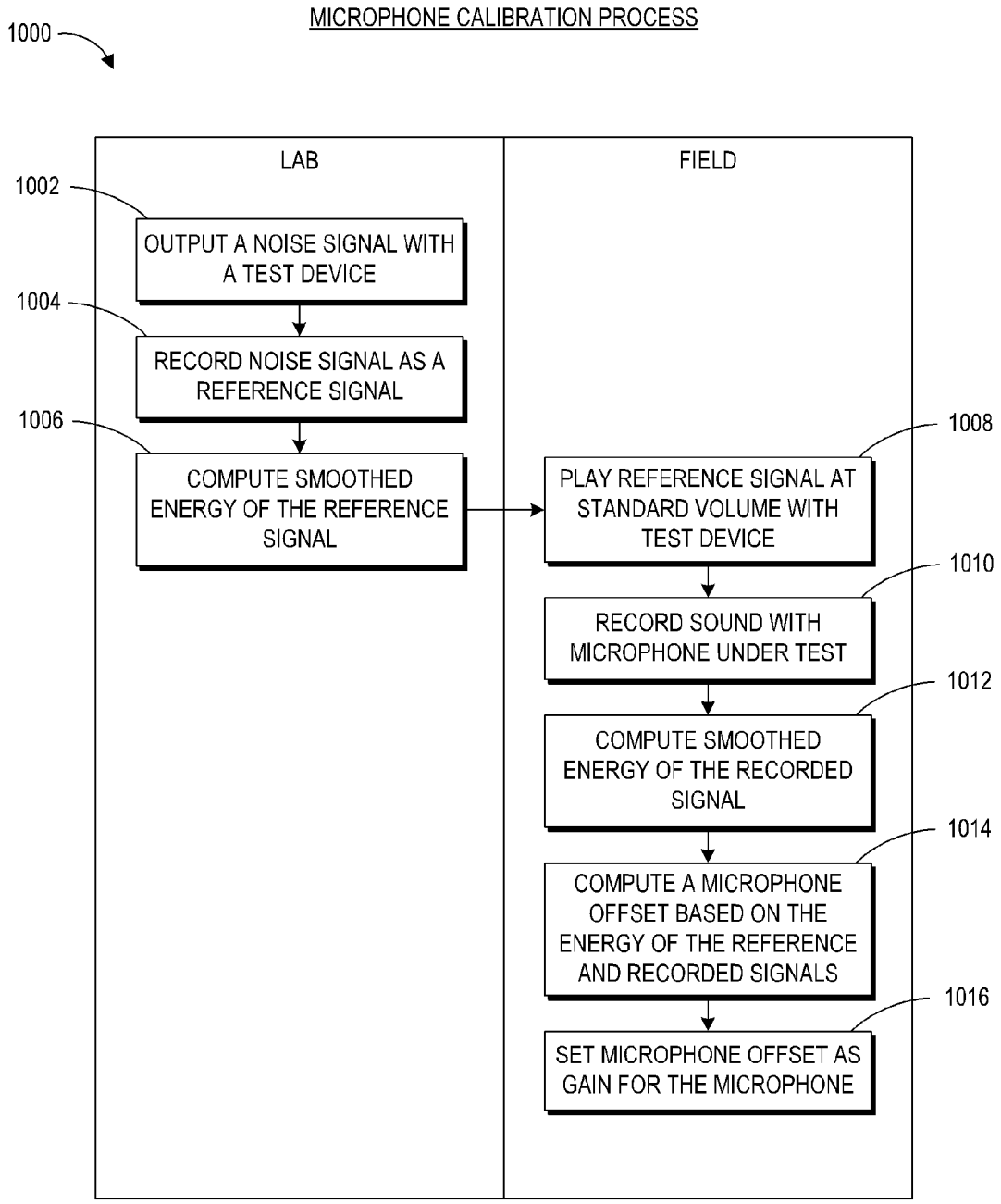
FIG. 10 illustrates an embodiment of a microphone calibration process.

FIG. 10 illustrates an embodiment of a microphone calibration process 1000. The microphone calibration process 1000 can be implemented at least in part by either of the voice enhancement systems 110, 210 described above. In one embodiment, the microphone calibration process 1000 is implemented at least in part by the microphone calibration module 234. As shown, a portion of the process 1000 can be implemented in the lab or design facility, while the remainder of the process 1000 can be implemented in the field, such as at a facility of a manufacturer of devices that incorporate the voice enhancement system 110 or 210.

As described above, the microphone calibration module 234 can compute and store one or more calibration parameters that adjust a gain applied to the microphone input signal 204 to cause an overall gain of the microphone to be the same or about the same for some or all devices. In contrast, existing approaches to leveling microphone gain across devices tend to be inconsistent, resulting in different noise levels activating the voice enhancement in different devices. In current microphone calibration approaches, a field engineer (e.g., at a device manufacturer facility or elsewhere) applies a trial-and-error approach by activating a playback speaker in a testing device to generate noise that will be picked up by the microphone in a phone or other device. The field engineer then attempts to calibrate the microphone such that the microphone signal is of a level that the voice enhancement controller 222 interprets as reaching a noise threshold, thereby causing the voice enhancement controller 222 to trigger or enable the voice enhancement. Inconsistency arises because every field engineer has a different feeling of the level of noise the microphone should pick up in order to reach the threshold that triggers the voice enhancement. Further, many microphones have a wide gain range (e.g., −40 dB to +40 dB), and it can therefore be difficult to find a precise gain number to use when tuning the microphones.

The microphone calibration process 1000 can compute a gain value for each microphone that can be more consistent than the current field-engineer trial-and-error approach. Starting in the lab, at block 1002, a noise signal is output with a test device, which may be any computing device having or coupled with suitable speakers. This noise signal is recorded as a reference signal at block 1004, and a smoothed energy is computed from the standard reference signal at block 1006. This smoothed energy, denoted RefPwr, can be a golden reference value that is used for automatic microphone calibration in the field.

In the field, automatic calibration can occur using the golden reference value RefPwr. At block 1008, the reference signal is played at standard volume with a test device, for example, by a field engineer. The reference signal can be played at the same volume that the noise signal was played at in block 1002 in the lab. At block 1010, the microphone calibration module 234 can record the sound received from the microphone under test. The microphone calibration module 234 then computes the smoothed energy of the recorded signal at block 1012, denoted as CaliPwr. At block 1014, the microphone calibration module 234 can compute a microphone offset based on the energy of the reference signal and recorded signals, for example, as follows: MicOffset=RefPwr/CaliPwr.

At block 1016, the microphone calibration module 234 sets the microphone offset as the gain for the microphone. When the microphone input signal 204 is received, this microphone offset can be applied as a calibration gain to the microphone input signal 204. As a result, the level of noise that causes the voice enhancement controller 222 to trigger the voice enhancement for the same threshold level can be the same or approximately the same across devices.

VII. Terminology

Many other variations than those described herein will be apparent from this disclosure. For example, depending on the embodiment, certain acts, events, or functions of any of the algorithms described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. For example, the vehicle management system 110 or 210 can be implemented by one or more computer systems or by a computer system including one or more processors. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method of adjusting a voice intelligibility enhancement, the method comprising:

receiving an input voice signal;

obtaining a spectral representation of the input voice signal with a linear predictive coding (LPC) process, the spectral representation comprising one or more formant frequencies;

adjusting the spectral representation of the input voice signal with one or more processors to produce an enhancement filter configured to emphasize the one or more formant frequencies, wherein the adjusting comprises decreasing a distance between line spectral pairs of at least one formant frequency obtained from the LPC process and thereby increasing a gain of a spectral peak associated with the at least one formant frequency;

applying an inverse filter to the input voice signal to obtain an excitation signal;

applying the enhancement filter to the excitation signal to produce a first modified voice signal with enhanced formant frequencies;

applying the enhancement filter to the input voice signal to produce a second modified voice signal;

combining at least a portion of the first modified voice signal with at least a portion of the second modified voice signal to produce a combined modified voice signal;

detecting an envelope based on the input voice signal;

analyzing the detected envelope to determine one or more temporal enhancement parameters;

applying the one or more temporal enhancement parameters to the combined modified voice signal to emphasize peaks in one or more time domain envelopes of the combined modified voice signal by increasing a slope of the peaks to produce an output voice signal with emphasized consonant sounds; and output the output voice signal for playback;

wherein at least said applying the one or more temporal enhancement parameters is performed by one or more processors.

2. The method of claim 1, wherein said detecting the envelope comprises detecting an envelope of one or more of the following: the input voice signal and the combined modified voice signal.

3. A system for adjusting a voice intelligibility enhancement, the system comprising:

an analysis module configured to obtain a spectral representation of at least a portion of an input audio signal, the spectral representation comprising one or more formant frequencies;

an inverse filter configured to be applied to the input audio signal to obtain an excitation signal;

a formant enhancement module configured to generate an enhancement filter configured to emphasize the one or more formant frequencies, wherein the enhancement filter is configured to decrease a distance between line spectral pairs of at least one formant frequency and thereby increase a gain of a spectral peak associated with the at least one formant frequency;

the enhancement filter configured to be applied to the excitation signal with one or more processors to produce a first modified voice signal, the enhancement filter further configured to be applied to the input audio signal with the one or more processors to produce a second modified voice signal;

a combiner configured to combine at least a portion of the first modified voice signal with at least a portion of the second modified voice signal to produce a combined modified voice signal;

a temporal enveloper shaper configured to apply a temporal enhancement to one or more time domain envelopes of the combined modified voice signal with the one or more processors to produce an output signal, the temporal enhancement configured to emphasize peaks in the one or more time domain envelopes by increasing a slope of the peaks to thereby emphasize one or more consonant sounds in the combined modified voice signal; and an output module configured to output the output signal for playback.

4. The system of claim 3, wherein the analysis module is further configured to obtain the spectral representation of the input audio signal using a linear predictive coding technique configured to generate coefficients that correspond to the spectral representation.

5. The system of claim 4, further comprising a mapping module configured to map the coefficients to line spectral pairs.

6. The system of claim 5, further comprising modifying the line spectral pairs using a modulation factor to increase gain in the spectral representation corresponding to the formant frequencies.

7. The system of claim 3, wherein the enhancement filter is further configured to be applied to one or more of the following: the input audio signal and the excitation signal derived from the input audio signal.

8. The system of claim 3, wherein the temporal envelope shaper is further configured to subdivide the combined modified voice signal into a plurality of bands, and wherein the one or more envelopes correspond to an envelope for at least some of the plurality of bands.

9. The system of claim 3, further comprising a voice enhancement controller configured to adjust a gain of the enhancement filter based at least partly on an amount of detected environmental noise in an input microphone signal.

10. The system of claim 9, further comprising a voice activity detector configured to detect voice in the input microphone signal and to control the voice enhancement controller responsive to the detected voice.

11. The system of claim 10, wherein the voice activity detector is further configured to cause the voice enhancement controller to adjust the gain of the enhancement filter based on a previous noise input responsive to detecting voice in the input microphone signal.

12. The system of claim 9, further comprising a microphone calibration module configured to set a gain of a microphone configured to receive the input microphone signal, wherein the microphone calibration module is further configured to set the gain based at least in part on a reference signal and a recorded noise signal.

13. A system for adjusting a voice intelligibility enhancement, the system comprising:

a linear predictive coding analysis module configured to apply a linear predictive coding (LPC) technique to obtain LPC coefficients that correspond to a spectrum of an input voice signal, the spectrum comprising one or more formant frequencies;

a mapping module configured to map the LPC coefficients to line spectral pairs;

a formant enhancement module configured to modify the line spectral pairs with one or more processors by at least applying a modulation factor to the line spectral pairs to decrease a distance between the line spectral pairs and thereby produce an enhancement filter configured to emphasize the formant frequency;

an inverse filter configured to be applied to the input audio signal to obtain an excitation signal;

the enhancement filter configured to be applied to the excitation signal to produce a first modified voice signal, the enhancement filter further configured to be applied to the input voice signal to produce a second modified voice signal;

a combiner configured to combine at least a portion of the first modified voice signal with at least a portion of the second modified voice signal to produce a combined modified voice signal; and an output module configured to output an audio signal based on the combined modified voice signal for playback.

14. The system of claim 13, further comprising a voice activity detector configured to detect voice in an input microphone signal and to cause a gain of the enhancement filter to be adjusted responsive to detecting voice in the input microphone signal.

15. The system of claim 14, further comprising a microphone calibration module configured to set a gain of a microphone configured to receive the input microphone signal, wherein the microphone calibration module is further configured to set the gain based at least in part on a reference signal and a recorded noise signal.

16. The system of claim 13, wherein the enhancement filter is further configured to be applied to one or more of the following: the input voice signal and the excitation signal derived from the input voice signal.

17. The system of claim 13, further comprising a temporal enveloper shaper configured to apply a temporal enhancement to the combined modified voice signal at least by increasing a slope of a temporal envelope in the combined modified voice signal.

18. The system of claim 3, wherein the combiner is configured to add at least a portion of the first modified voice signal with at least a portion of the second modified voice signal to produce the combined modified voice signal.

19. The system of claim 18, further comprising a gain module configured to adjust, based at least partly on an amount of detected environmental noise, a gain of one or more of the first modified voice signal and the second modified voice signal.

20. The method of claim 1, wherein the combining comprises adding at least a portion of the first modified voice signal with at least a portion of the second modified voice signal to produce the combined modified voice signal.

21. The system of claim 18, wherein the combiner is configured to add at least a portion of the first modified voice signal with at least a portion of the second modified voice signal to produce the combined modified voice signal.

* * * * *